US007198183B2

(12) United States Patent
Yang

(10) Patent No.: US 7,198,183 B2
(45) Date of Patent: Apr. 3, 2007

(54) ADJUSTABLE DUAL STRAP FOR CARRYING GOLF BAG

(76) Inventor: Chih-Hsiang Yang, P.O. Box No. 6-57, Junghe, Taipei 235 (TW)

( * ) Notice: Subject to any disclaimer, the term of this patent is extended or adjusted under 35 U.S.C. 154(b) by 585 days.

(21) Appl. No.: 10/751,965

(22) Filed: Jan. 7, 2004

(65) Prior Publication Data

US 2005/0145658 A1 Jul. 7, 2005

(51) Int. Cl.
*A45F 3/04* (2006.01)

(52) U.S. Cl. ..... 224/260; 24/313; 24/579.11; 24/605; 24/615; 24/DIG. 56; 224/260; 224/627; 206/315.3

(58) Field of Classification Search ..... 224/260, 224/627; 206/315.3; 24/313, 579.11, 605, 24/615, DIG. 56, 616
See application file for complete search history.

(56) References Cited

U.S. PATENT DOCUMENTS 908,288 A * 12/1908 Lovekin ..... 24/313
2,108,716 A * 2/1938 Kuhlemann ..... 244/151 R
2,416,757 A * 3/1947 Johnston ..... 24/579.11
2,430,341 A * 11/1947 Johnston ..... 24/579.11
2,469,391 A * 5/1949 Horning ..... 24/305
5,184,764 A * 2/1993 Orovan et al. ..... 224/636
5,319,836 A * 6/1994 Ida ..... 24/625
5,533,655 A * 7/1996 Duque ..... 224/602
6,457,620 B1 * 10/2002 Batten et al. ..... 224/645
6,926,183 B2 * 8/2005 Chang ..... 224/260

* cited by examiner

*Primary Examiner*—Tri M. Mai

(57) ABSTRACT

The invention herein relates to an adjustable dual straps structure allowing the user to comfortably back-carry a golf bag and mainly consists of two shoulder straps and two support straps. One end of the shoulder straps being buckled together while the other ends thereof are respectively tied to a golf bag. The buckled end of both shoulder straps holds a male buckle, while the buckled end of both support straps holds a female buckle. Each male buckle being fastened to corresponding female buckle, meanwhile both female buckles are fastened on each other. When carrying the golf bag, the user can adjust this angle according to his preference, turning both shoulder straps until they reach the angle where the golf bag can be most comfortably carried.

1 Claim, 6 Drawing Sheets

ADJUSTABLE DUAL STRAP FOR CARRYING GOLF BAG

BACKGROUND OF THE INVENTION a) Field of the Invention

The invention herein relates to an adjustable dual strap for carrying a golf bag, more specifically to a dual strap having shoulder straps can be positioned at an angle where the user can comfortably carry the golf bag on his back, according to his preference.

b) Description of the Prior Art

Referring to FIG. 1, most conventional dual straps 1 used to carry a golf bag mainly comprise a pair of symmetrical shoulder straps 11, wherein, a bottom end thereof is tied to a set of support straps 13. The other end of the shoulder straps 11 and support straps 13 are respectively fastened to a golf bag 14. Therefore thanks to the dual strap 1, the user can carry the golf bag 14 on his back.

However, the design of golf bag's conventional dual strap 1 is fixed, there is no way to adjust the angle formed by the straps. So, the shoulder straps 11 can only take a sole position on the shoulders. Therefore, the user can make no adjustment; he has no way to turn the shoulder straps 11 to a comfortable angle while carrying the golf bag 14. Therefore, the user's shoulders can feel very uncomfortable; this can even put inappropriate pressures on the shoulder and result in muscle injuries.

SUMMARY OF THE INVENTION

The invention of an adjustable dual strap consists of a first shoulder strap, a second shoulder strap, a first support strap and a second support strap; one end of each of the four straps thereof being buckled together, whereas the other end is respectively attached to a golf bag. Therefore, thanks to the dual strap, the user can carry the golf bag on his back. Each end of both the shoulder straps holds a male buckle, while each end of the both support straps holds a first part and a second part of a female buckle. Each male buckle being fastened corresponding to the first part and the second part of the female buckle, moreover, the two parts thereof also cling on each other. By the aforesaid structure, both shoulder straps can be turned to any desired angle. When the user carry the golf bag, he can adjust this angle according to his preference, turning both shoulder straps until they reach the angle where the golf bag can be most comfortably carried. Therefore, the objective of adapting to any morphology is reached, thereby eliminating the drawbacks of previous designs.

The primary object of the invention is to provide a dual symmetrical buckle. The male buckles respectively holds a round button thereon, wherein, each button includes at least one springy plate having at least one protruding cog. The female buckle including the first part and the second part each respectively presents an eye-let thereby correspondingly facing and fastening the round button. A rim of each eye-let is formed by a plurality of adjacent notches thereby allowing the round button being turned inside the corresponding eye-let through movement of the shoulder straps, enabling the cog of the springy plate fitting into one of the notches and fixing a certain angle.

The other object of the invention is to provide the structure of the female buckle having the first and second part fastened to each other. The second part of the female buckle holds a bigger round button; wherein, the bigger round includes at least one bigger springy plate having at least one protruding bigger cog. Opposite to the bigger round button, the first part of the female buckle presents a bigger eye-let allowing the bigger button to be secured. A rim of the bigger eye-let presents a plurality of adjacent bigger notches, thereby allowing the bigger button turning inside the bigger eye-let enabling the bigger cog of the bigger springy plate fitting into one of the bigger notches thus fixing a certain angle. Thus, the support straps will be fastened at a desired angle by means of the bigger cog of the bigger springy plate fitting into one of the notches.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
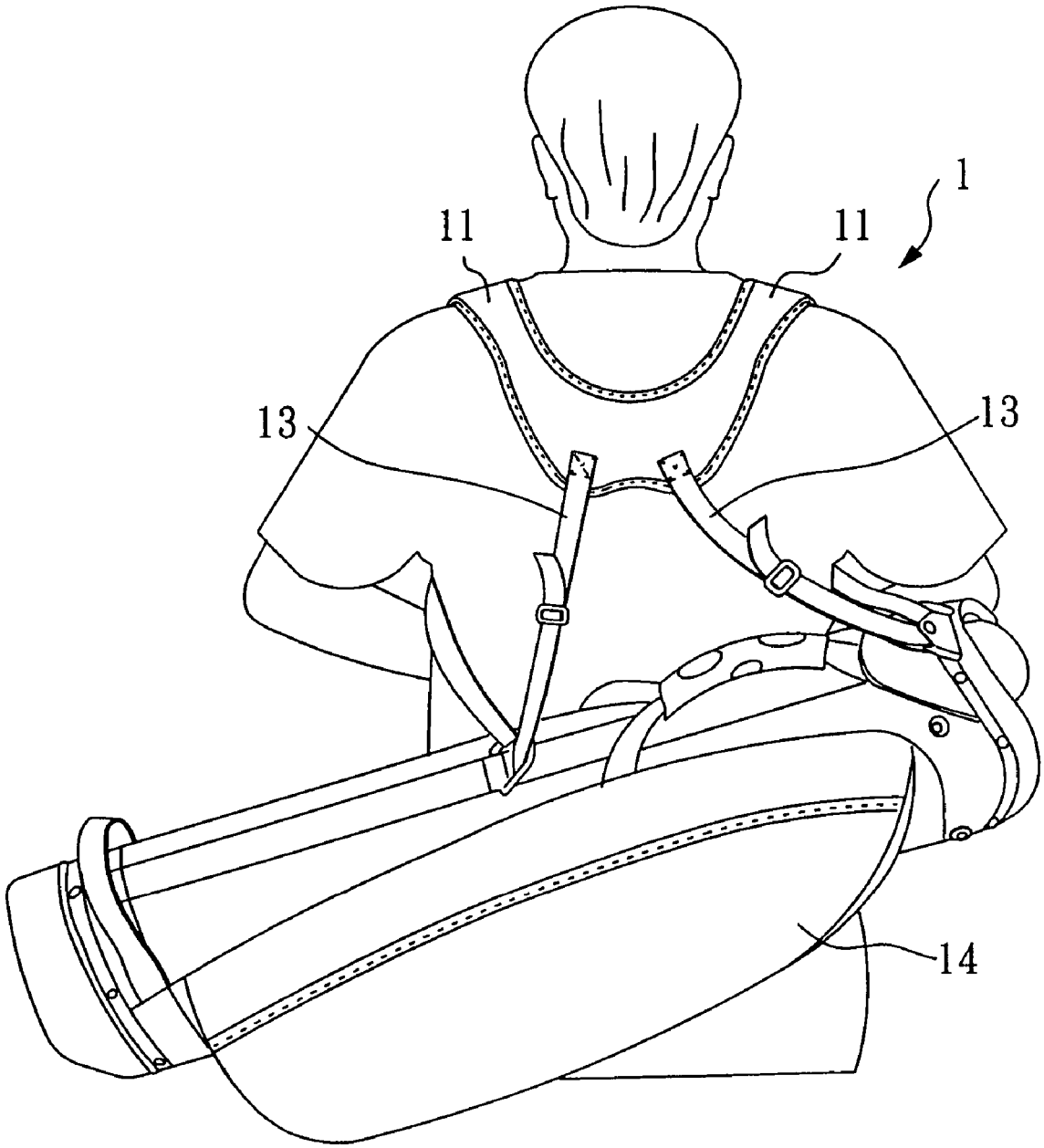
FIG.1 Prior Art
FIG. 1 is a schematic drawing of conventional structure in use.
Figure 2:
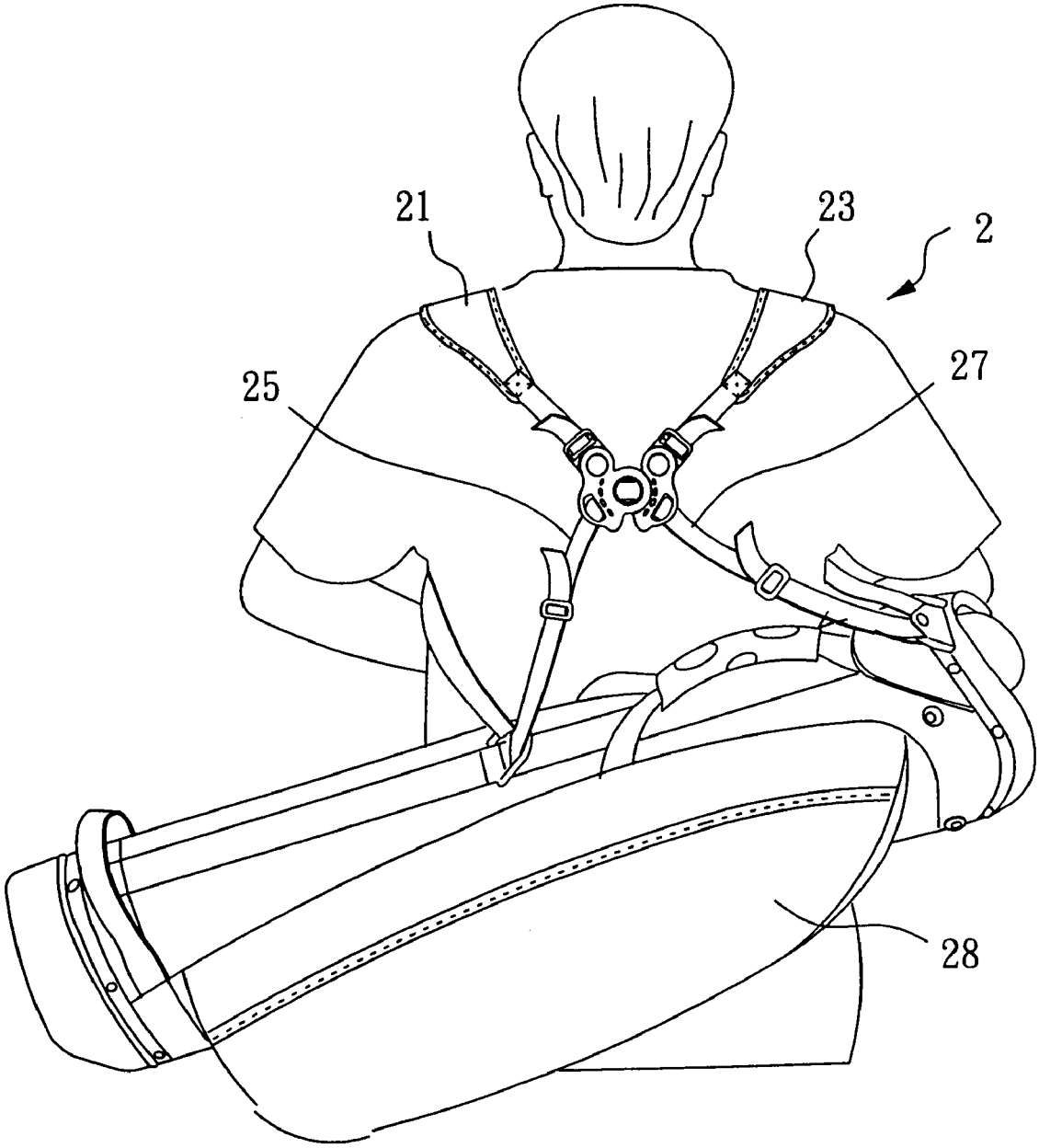
FIG. 2 is a schematic drawing illustrating one applicable from of the invention in use.
Figure 3:
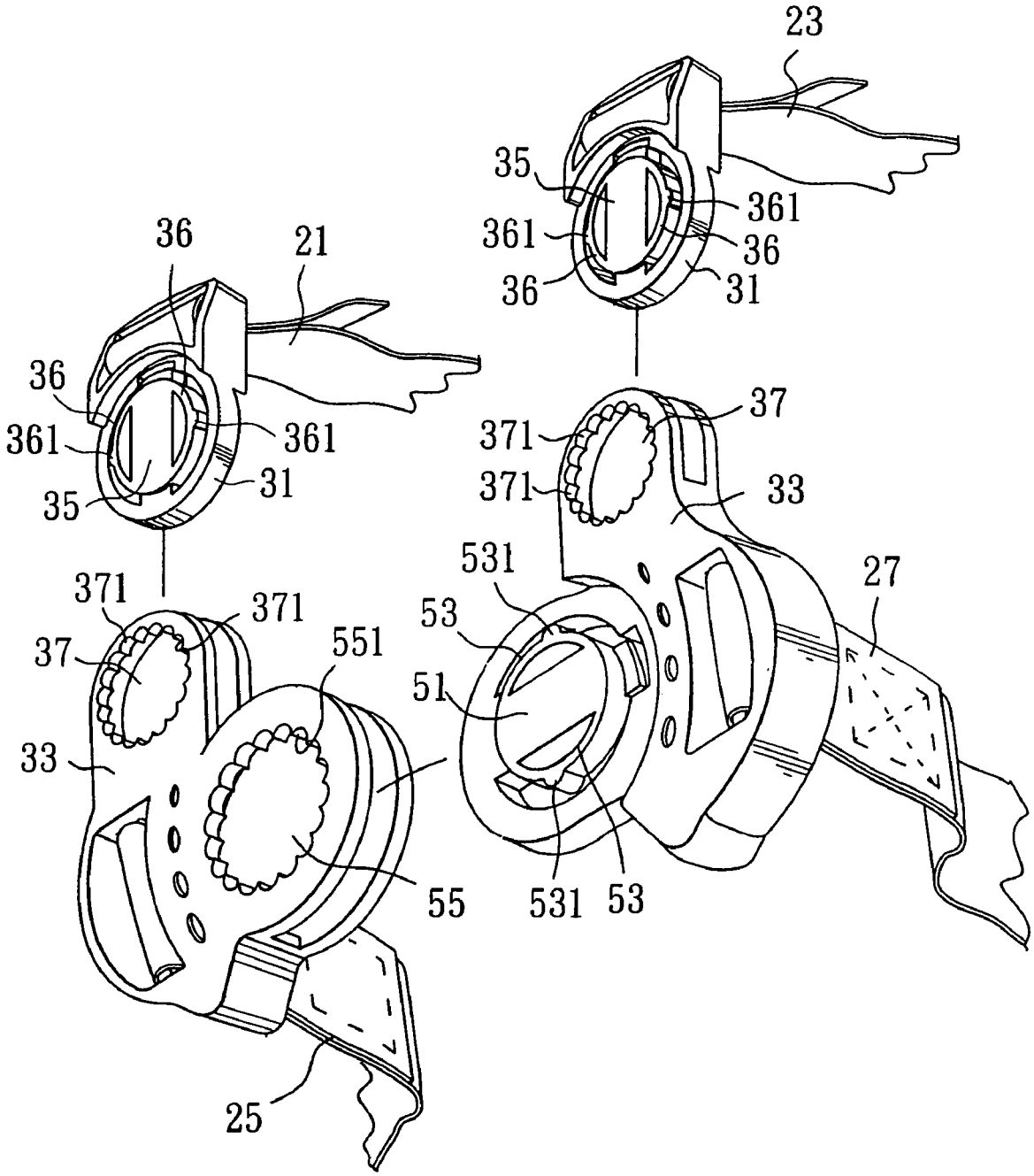
FIG. 3 is a perspective exploded drawing of the invention herein.

Referring to FIG. 2 and FIG. 3, the invention mainly consists of a dual shoulder strap 2, which is adjustable to allow the user to comfortably carry a golf bag. The dual shoulder strap 2 comprises a first shoulder strap 21, a second shoulder strap 23, a first support strap 25 and a second support strap 27. One end of the first and second shoulder straps 21, 23 and one end of the first and second strap 25, 27 are buckled together, while the other end of each strap is respectively attached to a golf bag 28, thereby enabling the user to utilize the dual shoulder strap 2 to carry the golf bag 28 on his back.

Figure 4:
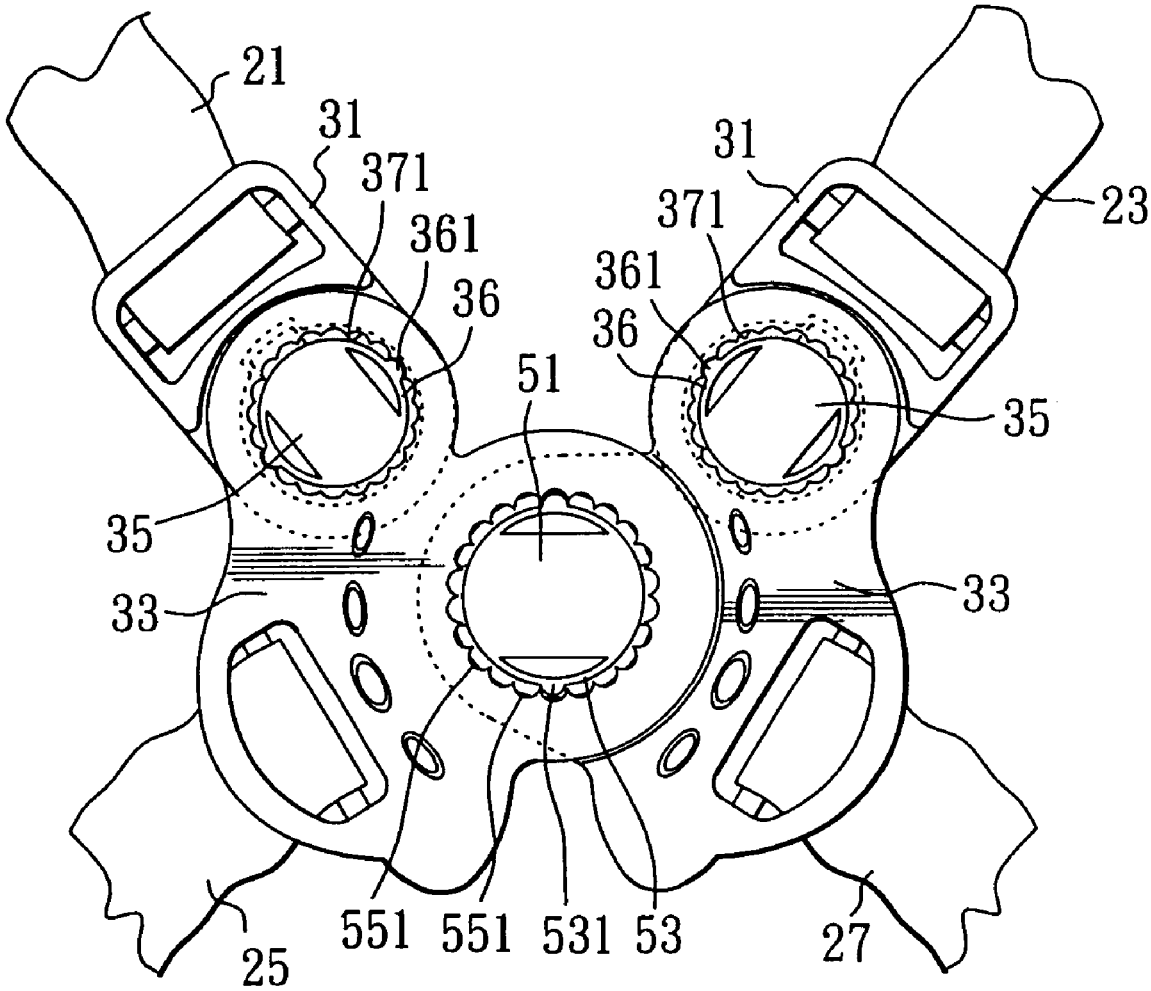
FIG. 4 is a schematic assembled view of the invention herein.
Figure 5:
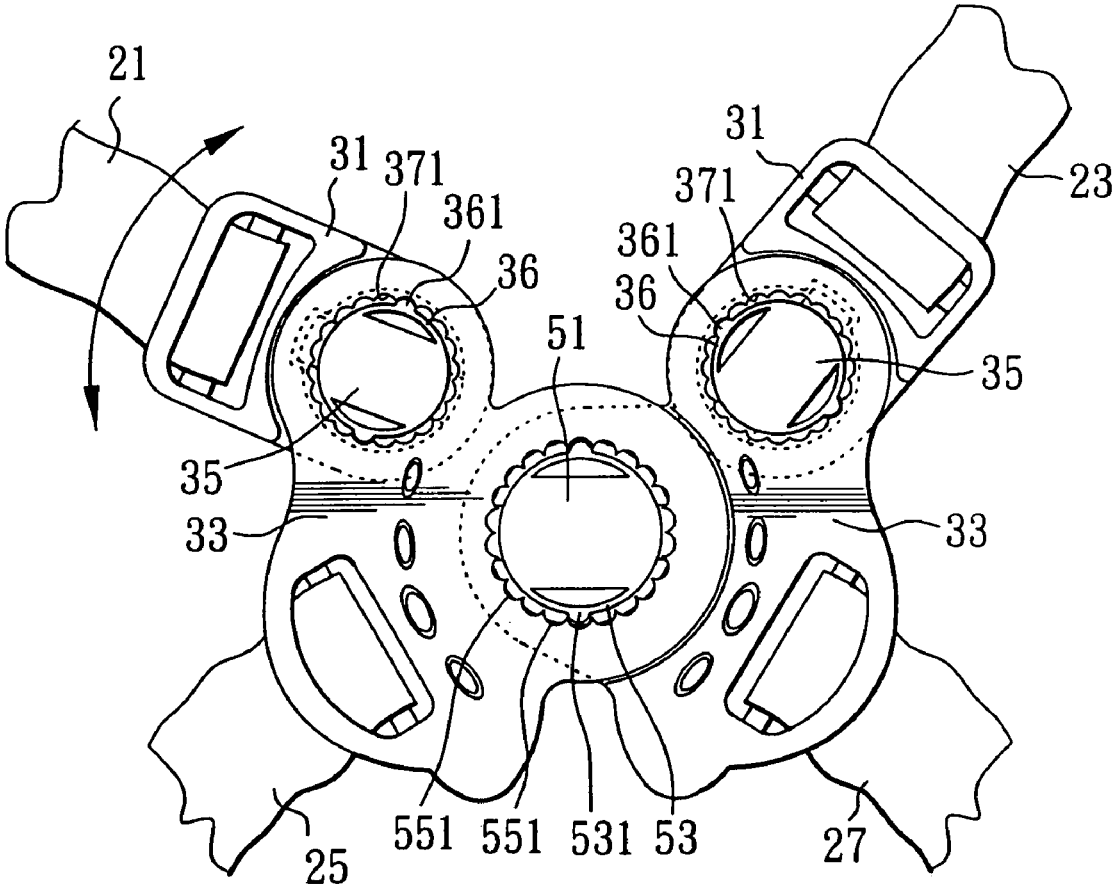
FIG. 5 is a schematic drawing illustrating movement of the invention herein.

Referring to FIG. 3–FIG. 5, the first shoulder strap 21 and the second shoulder strap 23 is disposed with male buckles 31 respectively, whereas the first support strap 25 and the second support strap 27 is disposed with a first part and a second part of a female buckle 33 respectively. The male buckles 31 respectively locks in the corresponding first part and second part of the female buckle 33 whereas the first part and the second part of the female buckle 33 buckles to each other, thereby allowing the shoulder straps 21 and 23 to be positioned to any desired angle.

On one hand, referring to FIG. 3–FIG. 6, the first shoulder strap 21 and the second shoulder strap 23 are fastened to one end of each male buckle 31, whereas the other end thereof is a round shaped button 35. On one side of each button 35, there is at least one springy plate 36 being formed, a rim portion thereof each having a protruding cog 361. Meanwhile, the first support strap 25 and the second support strap 27 are attached to the first part and the second part of the female buckle 33 respectively forming an eye-let 37 on each part thereby fastening each button 35. An inner rim of each eye-let 37 presents a plurality of adjacent notches 371 in shape, thereby allowing the button 35 to be inserted to the corresponding eye-let 37 further enabling the cog 361 of the springy plate 36 fitting into one of the notches 37 thus fixing a certain angle when the shoulder straps 21 and 23 being turned.

Figure 6:
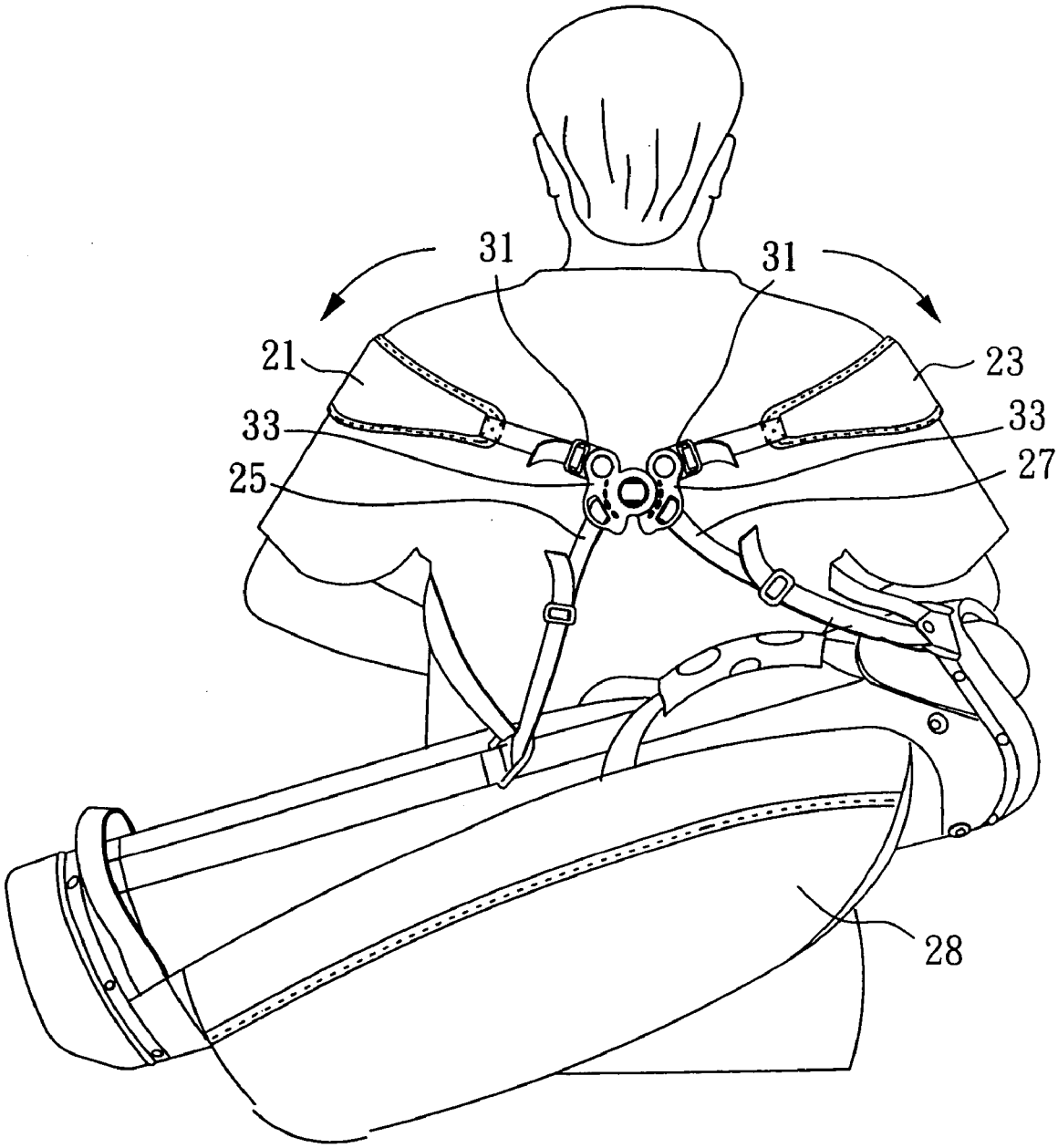
FIG. 6 is a schematic drawing illustrating another applicable form with movement of the invention in use.

On the other hand, the second part of the female buckle 33 consists of a bigger round button 51 formed on an inner side connected to the second support strap 27, wherein, a rim portion thereof includes at least one bigger springy plate 53 having at least one protruding big cog 531. Opposite to the bigger button 51, the first part of the female buckle 33 presents a bigger eye-let 55 whereby allowing the bigger button 51 to be securely inserted. An inner rim of the bigger eye-let 55 is formed by a plurality of adjacent bigger notches 551 thereby allowing the bigger button 51 to be turned inside the bigger eye-let 55, enabling the bigger cog 531 of the bigger springy plate 53 fitting into one of the bigger notches 551 thus fixing a certain angle. Referring to FIG. 2 and FIG. 6, when the user carries the golf bag 28 on his back, he can adjust the angle according to his preference, turning the first and second shoulder straps 21, 23 and the first and second support straps 25, 27 until they reach an appropriate position where the golf bag 28 can be comfortably carried, adapting to the user's morphology and avoiding any back or shoulder pain.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An adjustable dual strap for carrying a golf bag comprising:

a first shoulder strap and a second shoulder strap having a male buckle respectively disposed on each end thereof;

a first support strap and a second support strap each having a first part and a second part of a female buckle respectively disposed on each end thereof; both the male buckles being fastened corresponding to each part of the female buckle; one end of the first and second shoulder strap and one end of the first and second support strap being buckled together, whereas the other end of each strap thereof being attached to a golf bag; the male buckles of the first and second shoulder straps each including a round button having at least one springy plate with at least one protruding cog thereon; both the first part and second part of the female buckle each including an eye-let allowing the round button of each male buckle being inserted; a rim of the eye-let forming a plurality of adjacent notches in shape thereby allowing the cog of the springy plate being fitted into one of the notches when the round button being turned through movement of the first and second shoulder straps thus positioning to a desired angle; the second part of the female buckles including a bigger round button, wherein, the bigger round button further including at least one bigger springy plate having at least one protruding bigger cog; a bigger eye-let formed on the first part of the female buckle corresponding to the bigger button whereby allowing the bigger button to be securely inserted; a rim of the bigger eye-let forming a plurality of adjacent bigger notches in shape whereby fixing the bigger cog of the bigger springy plate into one of the bigger notches when turning the bigger button to a certain angle.

* * * * *